United States Patent [19]

Maidlow

[11] Patent Number: 4,654,950

[45] Date of Patent: Apr. 7, 1987

[54] STABBING PROTECTOR WITH FLEX FITTING INSERTS AND METHOD OF ATTACHING SAME IN WORKING POSITION

[75] Inventor: Delbert K. Maidlow, Humble, Tex.

[73] Assignee: Hydril Company, Houston, Tex.

[21] Appl. No.: 902,009

[22] Filed: Aug. 28, 1986

Related U.S. Application Data

[63] Continuation of Ser. No. 622,751, Jun. 20, 1984, abandoned.

[51] Int. Cl.[4] ..... B25B 27/14

[52] U.S. Cl. ..... 29/428; 29/272

[58] Field of Search ..... 29/272, 428; 285/27; 141/337, 131, 340; 277/207 A; 254/134.3 R; 403/372, 225

[56] References Cited

U.S. PATENT DOCUMENTS

| | | | |
|---|---|---|---|
| 3,135,519 | 6/1964 | Ligon et al. | 277/207 A X |
| 3,475,038 | 10/1969 | Matherne | 285/27 |
| 3,857,589 | 12/1974 | Oostenbrink | 277/207 A X |
| 4,213,237 | 7/1980 | Whiting | 29/272 |
| 4,318,547 | 3/1982 | Ericson | 285/27 X |
| 4,458,904 | 7/1984 | Delhaes | 277/207 A |

FOREIGN PATENT DOCUMENTS

| | | | |
|---|---|---|---|
| 143034 | 12/1978 | Japan | 285/27 |

OTHER PUBLICATIONS

Brochure for Hydril Service Tools, re stabbing guides.
Brochure for Tube Alloy Corp., "Stabbing Guide".
Whiting Oilfield Rental Inc., brochure, Whiting Seal Ring and Whiting Stabbing Guide.
Sigma Chemie brochure, Sigma-Chemie Stabbing Guides.

*Primary Examiner*—Frederick R. Schmidt
*Assistant Examiner*—Steven P. Schad
*Attorney, Agent, or Firm*—Vaden, Eickenroht, Thompson & Boulware

[57] ABSTRACT

A stabbing protector assembly including a replaceable elastomeric insert capable of accommodating to a range of ends of tubular goods. The internal surface of the elongate portion includes flexible internally projecting fingers that bend over and maintain holding and positioning contact for a range of outside diameter dimensions of box ends. The conical entry is made with a flexible internal bulbous portion that flexes while maintaining centering of a range of outside diameter dimensions of pin ends.

24 Claims, 6 Drawing Figures

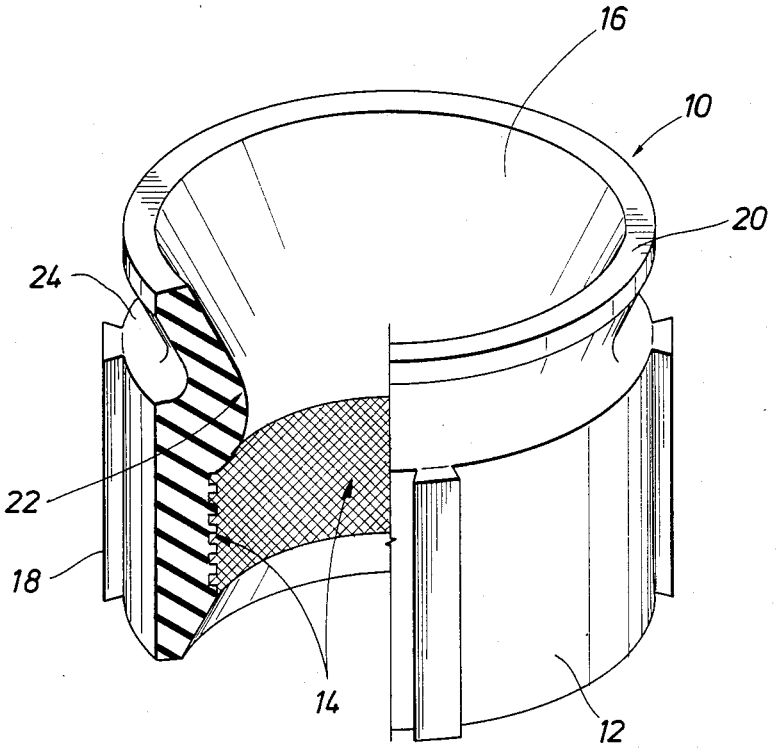
FIG. 1
FIG. 3
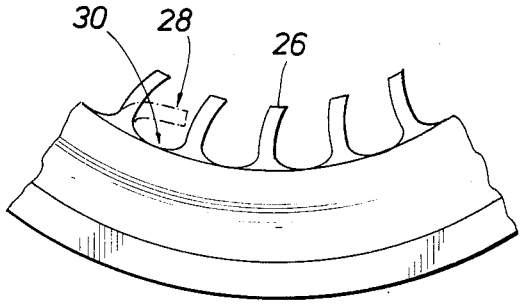
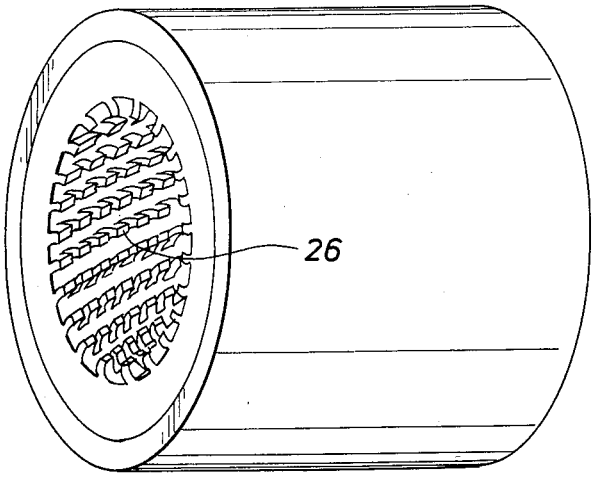
FIG. 2

FIG. 4
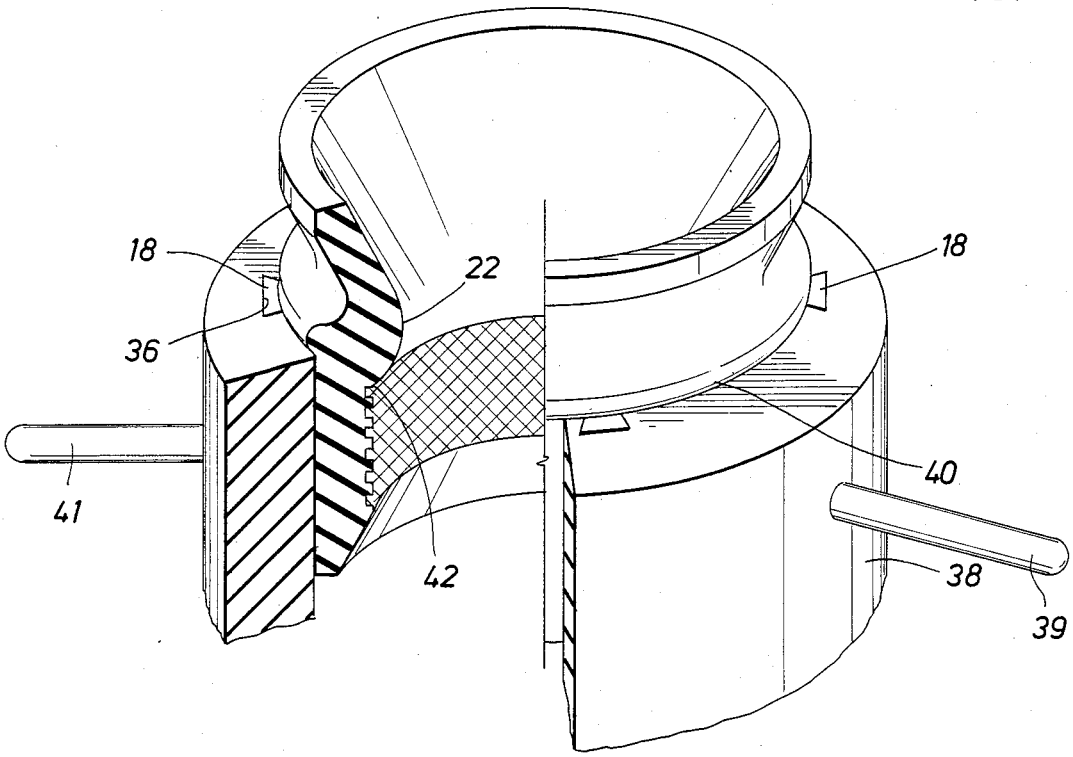
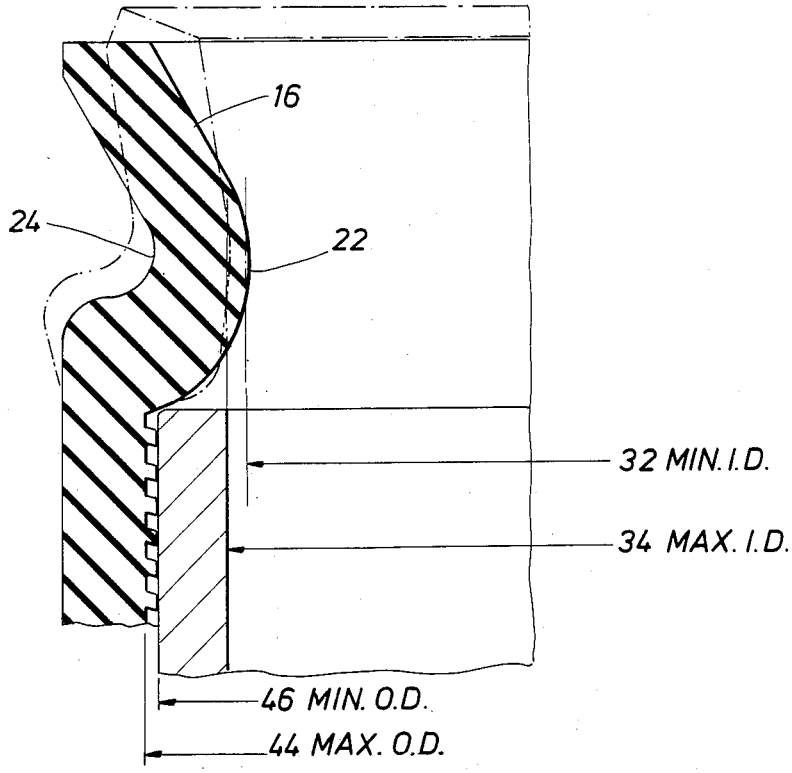
FIG. 5

STABBING PROTECTOR WITH FLEX FITTING INSERTS AND METHOD OF ATTACHING SAME IN WORKING POSITION

This application is a continuation, of application Ser. No. 622,75, filed 6-20-84 now abandoned.

BACKGROUND OF THE INVENTION

1. Field of the Invention

This invention relates to making tubular joint connections and more particularly to an improvement in a stabbing guide construction for assisting in making such connections.

2. Description of the Prior Art

The connecting ends of lengths of tubular goods are referred to as the pin end and the box end. When consecutive joints are connected together in making up a string of such joints, it is normal that one joint is suspended above the other in an appropriate holding and handling rig and then lowered so that the pin end "stabs" into the box end. The external surface area of the pin end and the receiving internal surface area of the box end primarily comprise the helical threads that make up the connection and the sealing and supporting surfaces that are located contiguous to the thread sets.

When the pin end, for example, of one tubular joint is stabbed into the box end of the adjacent joint, it is very common for the joints not to be perfectly axially aligned or for that matter for the centerline of one joint to be at a slight angle to the centerline of the other joint. Moreover, the holding and handling apparatus normally employed does not normally position the joint being manipulated with precision or without considerable force. Therefore, when the pin end is stabbed into the box end, threads are often damaged or broken and the supporting and sealing shoulders and other surfaces are often scarred, resulting in poor connections and causing pressure leaks and the like.

It has long been recognized that stabbing damage could be reduced or avoided altogether by the use of an appropriate stabbing guide. Such a guide normally is made to fit around the stationary joint end, normally the box end, thereby to both cushion the stabbing impact as well as to position or direct the handled end, normally the suspended joint with its pin end down, so that it funnels into makeup position within the accommodating box end without destructive consequences. Such guides are usually enclosed either in a two-part housing releasable by a catch-and-hinge arrangement or in a split one-piece flexible housing releasably held in place by a single catch. A guide is put in position by handles located on each of the two split hinged halves or affixedly located on opposite sides of the split for the one-piece type guide.

The guides, also sometimes referred to as protectors, have employed either resilient material, for example rubber or a rubber-like equivalent, or a material that was softer than the threads of the tubular goods being joined, for example, aluminum for protecting and guiding steel threaded ends. Because the guides or protectors themselves are subject to potentially damaging forces, they are destroyed or rendered non-effective after substantial use. It has also been recognized, heretofore, that by making guides so that they could accommodate or accept suitable replaceable inserts or linings, the life of the substantial housing or outer carrier portion of a guide could be greatly extended.

Tubular goods used in oil and gas production come in various sizes, all the way from large casings to relatively small drill pipe. A guide suitable for one size pipe or tubular goods is not suitable for use with another size pipe or tubular goods. If guides were placed in inventory for all goods that might be employed at a particular location, the inventory of sizes of such guides might well be substantial. It is sometimes difficult to get crews to use stabbing guides at all because it represents an additional handled item apart from all other apparatus employed. By asking such crews to keep and maintain a large inventory of separate guides, it makes regular and routine use of stabbing guides even more improbable, resulting in an increase of damaged joint ends and the putting in service of ends making faulty connections.

Therefore, it is a feature of the present invention to provide a stabbing guide having a housing and a replaceable insert suitable for use with a range of tubular goods, rather than just one size.

It is another feature of the present invention to provide a stabbing guide having a plurality of internal resilient projections, preferably in the form of foldover fingers, that accommodate to a range of outside dimension tubular products, while centering all such products within the range.

It is still another feature of the present invention to provide a stabbing guide with a replaceable insert useful for accommodating a range of sizes of pipe or other tubular goods having an entry larger than the outside diameter dimension of the sleeve portion of the insert within the housing.

SUMMARY OF THE INVENTION

A preferred embodiment of the stabbing guide of the present invention includes an annular housing that is both adjustable and removable for accommodating to a range of outside diameter sizes of tubular goods. The exact form of the housing is not important to the present invention, although it normally is one piece or split into two sections that are hinged together. Preferably, the housing would be large enough that, with its insert included therein, it would substantially surround the box end of the connection to be made up. If it is large enough so as to surround at least seven/eighths of the circumference, it would still function as a suitable stabbing guide.

A resilient insert includes a body having a sleeve portion, the entire insert being split along one elongate side. It is attached to the inside of the housing, such as by a tongue-and-groove arrangement, and includes a patterned field of internal projections. Preferably, the field is patterned in such a manner that the rows in the field are at a substantial angle to the centerline of the housing, 45° being preferred. This provides optimum stability to keep the guide itself in a centered position. Each of the projections is preferably a rectangular cross-sectioned finger that folds or bends over as the guide is squeezed around the box end and presses against it: however, each projection remains resiliently strong even in its mid-bentover condition.

The entry end is funnel-like for receiving even an off-centered pin end and is somewhat larger than the sleeve portion of the insert. When the sleeve portion is inserted into the housing, the larger entry end limits or positions the insert within the housing at the proper location.

The inside diameter of the resilient insert just above the patterned field, and at the deepest well location of the entry, is slightly smaller than the inside diameter of the sleeve portion of the insert. This presents a shoulder for the end of the box end and ensures that the box end is not exposed to the stabbing pin end before the pin end encounters the funnel entry surface of the protecting insert.

The fingers permit accommodating to range of box ends. A further extension of the range is permitted for a common stabbing protector guide housing by employing similar inserts with different wall thicknesses, thereby accomplishing an overall minimum stocking of parts.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the drawings, which drawings form a part of this specification. It is to be noted, however, that the appended drawings illustrate only a preferred embodiment of the invention and are therefore not to be considered limiting of its scope, for the invention may admit to other equally effective embodiments.

IN THE DRAWINGS

Figure 6:
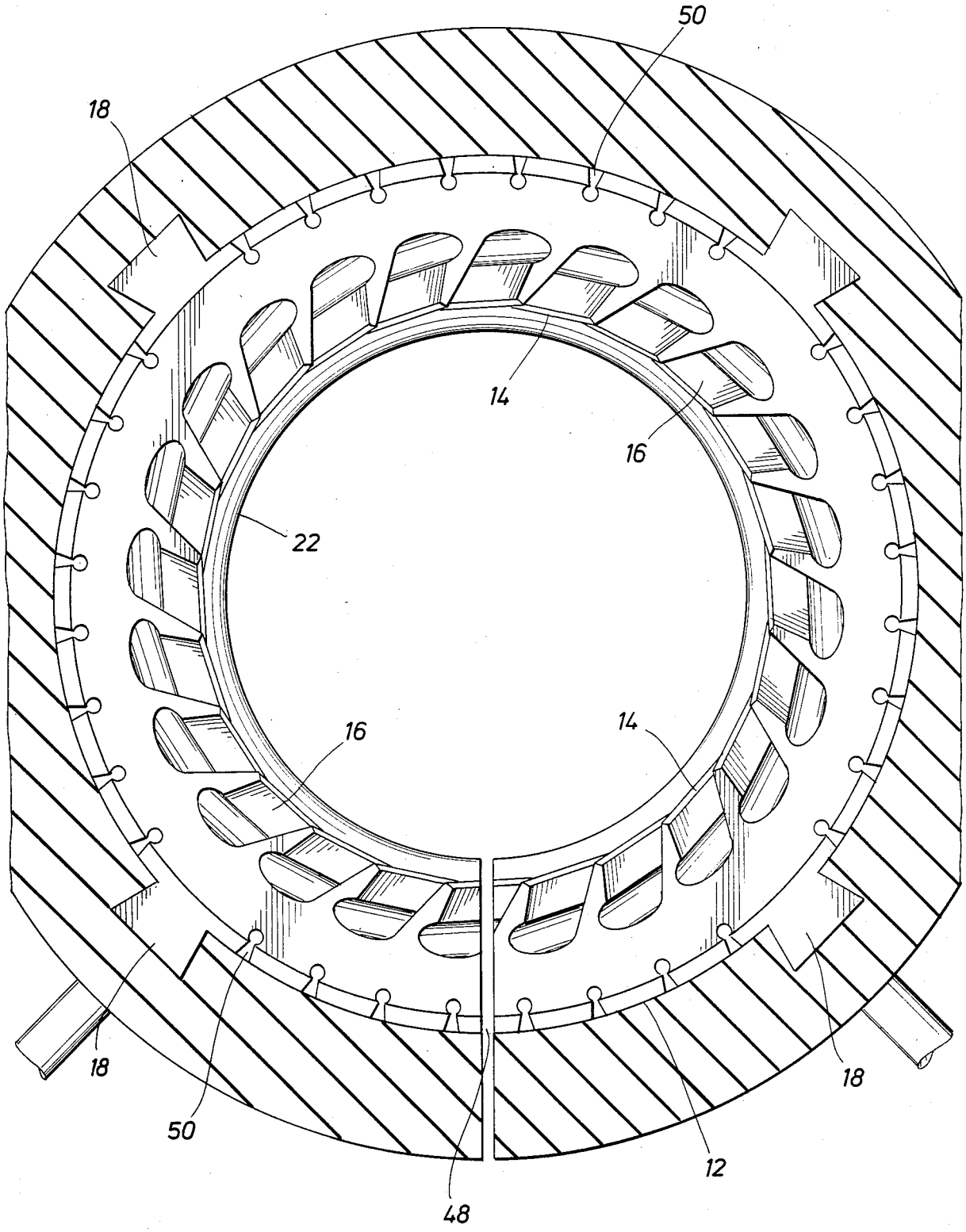

FIG. 1 is an isometric view of a preferred embodiment of a stabbing protector insert in accordance with the present invention, the illustration partially being in cutaway.

FIG. 2 is an isometric view of the internal surface of the protector insert shown in FIG. 1, illustrating the pattern of the internally projecting fingers thereof.

FIG. 3 is an enlarged view of the internal projecting finger action in accordance with the present invention.

FIG. 4 is an isometric view of a preferred view of a stabbing protector guide housing and insert combination in accordance with the present invention, partly shown in cutaway.

FIG. 5 is a partial cross-sectional view of the entry structure of the insert shown in FIGS. 1–4.

FIG. 6 is a bottom view of the housing and insert in a closed assembled position.

DESCRIPTION OF THE PREFERRED EMBODIMENT

Now referring to FIG. 1, a stabbing protector insert 10 in accordance with the present invention is shown in a cutaway, isometric view. Generally, the insert is elongated with an external or outside dimension surface 12 and an internal dimension surface 14. The internal surface incorporates therein a pattern of internally projecting fingers in accordance with a description which is set forth hereafter. The entry portion of the insert is conically shaped along surface 16 to accommodate the stabbing insertion of a pin end of a tubular product immediately prior to connection makeup.

The insert is made of resilient material, typically natural rubber, neoprene or other elastomeric material, and is contoured in its external dimension so as to include a plurality of elongate tongues 18 for insertion into accommodating grooves included in the internal wall of a suitable stabbing guide housing.

Returning to the conical entry portion of the insert in the relaxed form, end 20 of the insert relaxes so that it forms an external diameter larger than the diameter of surface 12. The internal diameter of the conical surface tapers to a bulbous or rounded internal surface which is smaller than the diameter of inside surface 14. The bulbous surface is identified by reference numeral 22. A groove 24 is included in the external surface opposite bulbous surface 22 so that the wall thickness dimension of the insert remains fairly constant in the area of the conical surface 16 forward or above bulbous surface 22. Such a structure permits the possibility of relatively easy flexing of the conical surface in a manner described more completely in connection with FIG. 5.

Now referring to the internal projection pattern, a plurality of "fingers" 26 are included in the pattern as more completely shown in FIGS. 2 and 3. The fingers are preferably included in rows and on an angle to the centerline of the insert, preferably on an angle of 45°, although a lesser angle can be employed, if desired.

Now referring to FIGS. 2 and 3, the fingers 26 are aligned so that under normal conditions they bend in use, as shown in bent position 28, in a direction toward a short dimension of the finger. The crest 30 between the fingers provides a slightly narrower cross-section dimension of a finger at the crest compared with the cross-section dimension at a peak of a finger so as to promote being at the crest location.

It may be seen that the individual fingers are quite small and the numbers of fingers in the overall pattern are quite large, although there is no criticality as to their exact number. This provides the gripping surfaces necessary to withstand the relatively rough treatment to the stabbing action, while giving the resiliency to the overall structure necessary to maintain alignment in conjunction with a range of box end dimensions. An individual finger provides its support over a range from a dimension provided by a nearly fully extended finger projection to a fully laid down finger projection, such as shown by lay down finger 28.

Now referring to FIG. 5, the insertion of a pin end with the smallest external diameter of dimension which would be fully in contact with such insert would be such that bulbous surface 22 bears slightly against it, the external diameter thereof being roughly along line 32 as shown in the diagram.

The largest pin external diameter that would be accommodated by the entry portion of the insert for alignment purposes would be roughly along line 34. It may be seen that bulbous surface 22 would be flexed in diaphragm fashion out of its at rest position as shown in dotted section. Such action would also result in moving conical surface 16 toward a closer accommodation to the slope of the pin end and would help in the alignment process. The bulbous surface would be pushed so far outwardly, however, so as to interfere with the position of the insert on the box end to which it is secured.

Now referring to FIG. 4, the insert which has just been described is shown inserted using tongues 18 into accommodating housing grooves 36 shown in housing 38. Housing 38 may take the form of any convenient housing configuration, well known in the art. The only essential structure of such housing is that it would include grooves 18 for attachably accepting the insert. For example, the housing may be of multiple sections. Preferably the housing is a single piece, hard rubber housing and is operable about the box end utilizing suitable handles 39 and 41. Also not shown, but in the art, are various kinds of locking enclosures for the two sections after the housing-with-insert is positioned about the accommodating box end immediately prior to use.

Referring again to FIG. 4, a replaceable insert is inserted via the tongue-and-groove connections/disconnections previously described until external shoulder 40 comes into contact with the top surface of the housing and thereby limits its further movement downward with respect to housing 38 during the stabbing action impact occurrence. This abrupt shoulder is made by a portion of the insert having an external diameter that is slightly larger than the remaining sleeve portion that fits inside the housing, the shoulder therebetween being slightly longitudinally toward the entry from bulbous surface 22.

In similar fashion, it may be seen that internal abrupt shoulder 42 is provided just below bulbous surface 22 so that it accommodates to the end surface of the box end of the tubular product to which the stabbing protector is attached. As shown in FIG. 5, the maximum outside diameter of a box end that would roughly be accommodated by the insert would be along line 44 and the minimum outside diameter box end that would be accommodated would be roughly along line 46.

Now referring to FIG. 6, a bottom view looking up through an insert is shown when the insert is completely configured about a box end so that the split section of the insert 48 is very narrow. It may be seen that in addition to tongues 18 which make possible attachment of the insert to a suitable housing, the external surface of the insert also includes a plurality of small grooves 50 which permit some flexible bending of the insert for conforming into the housing. As illustrated along its full circumference, such grooves 50 may be included only partly around the rear portion of its circumference if desired. However, most of the flexing occurs in a normal application in the vicinity of the hinge, which is 180° opposite opening slit 48. Therefore, most of the flexing occurs in the locations of where the grooves 50 are illustrated in FIG. 6.

Inserts for a particular housing may vary in wall thickness dimension. This provides a number of different sized inserts to be accommodated by a common housing and thereby provides a more complete range of accommodation to suitable tubular goods than would be provided by a single sized insert.

In normal practice, in order to accommodate to a full compliment or range of tubular goods, it may be necessary to have a plurality of inserts for each of a plurality of housings. For example, three different size inserts can be made for accommodating or attaching to a single size housing. Three appropriate sized housings each capable of accommodating three inserts would give a complete range to fit nine different sizes of tubular products.

While a particular embodiment configuration of the invention has been shown and described, it will be understood that the invention is not limited thereto, since many modifications may be made and will become apparent to those skilled in the art. For example, it is preferable that one continuous structure comprise a single insert. However, an insert could be made up of two or more separate sections, if desired. Even a unitary structure including the flexible fitting feature described above for a particular range of sizes is within the spirit of the invention.

What is claimed is:

1. In combination with a stabbing guide for centering the making of a connection between the pin end of a first joint and the accommodating box end of the adjacent second joint, said stabbing guide including a removable annular housing that axially separates on at least one side for surrounding at least a substantial circumferential portion of the box end, and a split resilient protector insert that axially separates at its split on at least one side located within and conforming to the internal annulus of said housing for absorbing the stabbing impact of said pin end into said box end and guidingly aligning the pin end threads into engagement with the box end threads, said split insert, comprising a plurality of resilient internal projections located circumferentially about the inside surface of said insert for contacting the outside surface of the box end, said projections suitable for accommodating a range of outside diameter box ends.

2. The stabbing guide in accordance with claim 1, wherein said projections each has a length dimension longer than its width dimension so that accommodation to the range of outside diameter box and dimension is caused by resilient bend over of said projections predominantly in their width directions.

3. The stabbing guide in accordance with claim 2, wherein the cross-section of an individual one of said projections is substantially rectangular.

4. The stabbing guide in accordance with claim 3, wherein said projections are formed on an angle to the centerline of said box end so that the predominant bend over is at an angle normal to said formation angle.

5. The stabbing guide in accordance with claim 1, and including longitudinal tongue-and-groove attachment means for connecting said protector insert to said housing in disconnect fashion to permit replacement of said insert.

6. The stabbing guide in accordance with claim 5, wherein said first-named insert has a wall thickness of a first dimension, said attachment means associated with said housing being suited for receiving other inserts having respective wall thicknesses different from said first wall thickness to permit accommodating an expanded range of outside-diameter pin ends.

7. The stabbing guide in accordance with claim 6, wherein each of said other inserts includes internal projections of substantially the same internal projection dimension as said internal projections of said first-named insert.

8. The stabbing guide in accordance with claim 6, wherein said first-named insert includes internal projections suitable for said insert accommodating to at least two standard sizes of box ends and each of said other inserts includes internal projections suitable for said respective other inserts to accommodate to at least two standard sizes of box ends.

9. The stabbing guide in accordance with claim 1, wherein said internal surface of said annular housing includes a plurality of internal grooves parallel with the centerline of said housing and said external surface of said insert includes accommodating attachment external tongues.

10. The stabbing guide in accordance with claim 9, wherein said external surface of said insert includes external limit means for properly longitudinally locating said insert within said housing at the time of attachment tongue-and-groove insertion, said insert including a conical entry end located above said limit means.

11. The stabbing guide in accordance with claim 10, wherein said limit means includes an external shoulder.

12. The stabbing guide in accordance with claim 1, wherein said internal surface of said insert includes internal limit means for properly longitudinally locating the box end within said insert.

13. The stabbing guide in accordance with claim 12, wherein said internal limit means includes an internal shoulder.

14. The stabbing guide in accordance with claim 1, wherein said housing includes a hinge to permit longitudinal opening of said housing.

15. The stabbing guide in accordance with claim 14, wherein the external surfaces of said insert includes a plurality of small longitudinal grooves to provide ease of conformity of said insert with said housing when said housing is operated open and then shut.

16. The stabbing guide in accordance with claim 1, wherein said insert includes a conically shaped entry having a bulbous internal diaphragm portion which bears against the smallest of the range of outside-diameter pin ends and is flexible in expanding to permit the passage of the largest of the range of outside-diameter pin ends.

17. The stabbing guide in accordance with claim 16, wherein the contour of the external surface of the guide at said entry at least approximately follows the contour of said bulbous internal diaphragm portion.

18. The process of providing the box end of a tubular product with a stabbing guide to protect against damage thereof and of the accommodated pin end during initial thread engagement caused by misalignment of said box end and pin end or caused by excessive impact during connection makeup, which comprises selecting a stabbing guide housing that longitudinally opens along at least one side equipped with provisions for removably accepting a plurality of split protector inserts that longitudinally open along the same one side as the guide housing, said inserts being of different wall thicknesses, fitting said housing with said selected protector insert, and placing the housing about said box end, the housing being circumferentially dimensioned to surround at least seven/eights of the circumference of the box end.

19. A subcombination of a stabbing guide protector insert, said insert longitudinally opening along at least one side, comprising a plurality of resilient internal individual finger projections located circumferentially about the inside surface of said insert, said projections being suitable for achieving the accommodation to a range of outside-diameter box ends when the insert is in service in a stabbing guide assembly.

20. A subcombination of a stabbing guide protector insert in accordance with claim 19, wherein said projections each has a length dimension longer than its width dimension so that accommodation to the range of outside diameter box end dimensions is caused by resilient bend over of said projections predominantly in their width directions.

21. A subcombination of a stabbing guide protector insert in accordance with claim 20, wherein the cross-section of an individual one of said projections is substantially rectangular.

22. A subcombination of a stabbing guide protector insert in accordance with claim 21, wherein said projections are formed on an angle to the elongated centerline.

23. The subcombination of a stabbing guide protector insert in accordance with claim 19, wherein said insert includes attachment means for connecting said insert to an accommodating housing therefor in disconnect fashion to permit replacement of said insert.

24. The subcombination of a stabbing guide protector in accordance with claim 19, wherein the external surface of said insert includes a plurality of small longitudinal grooves to provide ease of holding conformity of said insert with said accommodating stabbing guide housing.

* * * * *